US005810574A

United States Patent [19]

Marx et al.

[11] Patent Number: 5,810,574

[45] Date of Patent: Sep. 22, 1998

[54] POWER PLANT

[76] Inventors: Konstantin Ivanovich Marx, ulitsa 11, korpus. 1, kv. 110, Moscow Domodedovskaya; Vitaly Egorovich Makeev, oblast, ulitsa Br. Gorozhankinykh, 8, kv.5, Moskovskaya oblast, Krasnogorsk, both of Russian Federation

[21] Appl. No.: 676,150

[22] PCT Filed: Jan. 16, 1995

[86] PCT No.: PCT/RU95/00004

§ 371 Date: Jul. 16, 1996

§ 102(e) Date: Jul. 16, 1996

[87] PCT Pub. No.: WO95/19492

PCT Pub. Date: Jul. 20, 1995

[30] Foreign Application Priority Data

Jan. 17, 1994 [RU] Russian Federation ..... 94001612

[51] Int. Cl.[6] ..... F02B 53/00; F04C 2/10

[52] U.S. Cl. ..... 418/61.3; 418/94; 418/140

[58] Field of Search ..... 123/242; 418/61.3, 418/94, 140

[56] References Cited

U.S. PATENT DOCUMENTS

| | | | |
|---|---|---|---|
| 2,162,771 | 6/1939 | Winans | 418/61.3 |
| 3,117,561 | 1/1964 | Bonavera | 123/242 |
| 3,199,496 | 8/1965 | Kell | 418/61.3 |
| 3,285,189 | 11/1966 | Doyer | 418/61.3 |
| 3,314,401 | 4/1967 | Kell | 123/242 |
| 3,441,007 | 4/1969 | Kwaak | 418/61.3 |
| 3,450,107 | 6/1969 | Radziwill et al. | 418/61.3 |
| 3,967,594 | 7/1976 | Campbell | 418/61.3 |
| 4,111,617 | 9/1978 | Gale et al. | 418/61.3 |
| 4,218,200 | 8/1980 | Morita et al. | 418/84 |
| 4,728,270 | 3/1988 | Hoffmann | 418/1 |
| 5,011,385 | 4/1991 | Eiermann | 418/61.2 |
| 5,100,309 | 3/1992 | Eiermann et al. | 418/61.2 |

FOREIGN PATENT DOCUMENTS

| | | | |
|---|---|---|---|
| 2264969 | 10/1975 | France | 418/61.3 |
| 2518737 | 9/1976 | Germany | 418/61.3 |

*Primary Examiner*—Michael Koczo
*Attorney, Agent, or Firm*—Pennie & Edmonds LLP

[57] ABSTRACT

The proposed power unit of the rotary-piston type, for example an internal combustion engine, compressor or pump, has a stator and a rotor designed in such a way as to allow a number of variable-volume working chambers to be created in the stator when the rotor turns. The meshing mechanism between the stator and the rotary piston which rotates on an eccentric section of the shaft is essential for the management of that rotation and is situated outside the rotary piston. For that purpose an aperture is provided in the wall of the stator and is shut off by a rotating disk (or ring) through which a spigot passes and rigidly connects the rotary piston and a pinion. This arrangement creates a power unit with a triangular stator and double-peak rotor. Several sets of balance, lamellate, spring-loaded sealing elements are mounted on the lateral surface of the stator. They are in contact with the side surface of the rotary piston which has a forced cooling system.

15 Claims, 18 Drawing Sheets

POWER PLANT

The invention relates to rotary machines, including rotary-piston engines, compressor and pumps and in particular, to internal combustion engines of rotary-piston type, which burn both liquid and gaseous fuel. Power plants are known in prior art to have rotary pistons (USSR Patent No. 639473 of Dec. 25, 1975, Inventors Danquart Eiermann and Felix Wankel, Applicant "Wankel GMBH", F.R.G., for an invention "Power Plant"). This power plant, according to USSR Patent No. 639473, has in one section a pair of working chambers of epitrochoidal profile with gas distribution ports and spark plugs, said chambers being offset from one another through an angle of 180°, and a compressor chamber arranged between them and provided with by-pass channels, which has its smaller axis arranged at an angle relative to smaller axes of the working 15 chambers. The power plant has also a common eccentric output shaft on which the eccentrics of the working chambers are turned 180° relative to the eccentrics of the compressor chamber, and rotors-pistons mounted on the eccentrics, wherein the working chambers are made to have an increased number of epitrochoid branches, and their rotors-pistons—to have respectively an increased number of faces, thus cooperating to define compression, expansion and exhaust cavities, said expansion cavities being connected with the compressor chamber within the zone of its smaller axis by additional by-pass channels of small cross-section. This arrangement coincides with the claimed one in some design features, the power plant comprises a stator with an internal volume, with the working chambers, an eccentric shaft, a rotor-piston with a tooth gear, said rotor-piston being mounted on an eccentric and conjugate to the stator by means of toothed gearing.

The arrangement according to USSR Patent 639473, like also other power plants of Wankel type, has disadvantages listed below.

Exhaust gases contain more toxic components than exhaust gases of piston engines. It is carbon monoxide that is given off in particularly large quantities. The compression ratio in the above-mentioned power plant is limited. Fuel mixture partially enters the exhaust manifold, thus reducing the engine's fuel economy. In the power plants of Wankel type, the sealings are mounted on the rotor so that they are, therefore, working under heavy-duty conditions (power plants of Wankel type, see also in the book: "Internal Conbustion Engines", Moscos, "Mashinostroeniye" Publishers, 1983, pages 289–293).

The closest prior art to this invention (its prototype) is represented by the inventions described in Polish Patents "An Engine or a Work Machine With a Rotary Piston" No. 48198 (priority of Nov. 8, 1962, publ. May 4, 1964, similar F.R.G. Patent No. 1451890, Inventors N. Radziwil and A. Broel-Plater) and "A Method for Sealing a Machine or an Engine With a Rotary Piston, and Also a Sealing Kit for Implementation of This Method" according to additional patent No. 48191, Kl. 46 a° 9, MKP OF2b of Nov. 8, 1962 by the same inventors (similar F.R.G. Patent No. 1451689. The arrangement according to the above-mentioned Polish patents can be used in pumps, engines, compressors, and in all these cases different are only inlet and outlet units for working medium and also units for initiating the working process.

The arrangement according to Polish Patent No. 48198 consists of a cylinder (stator) shaped as a regular polygon, as well as a rotary piston placed inside it, which has the cross-section thereof represented by the envelopes of cylinder wall elements interacting therewith, said envelopes being defined by mathematical equations in the plane of motion. At the same time, the piston is connected with the main shaft by means of an eccentric portion of the shaft, and also with the housing, by means of a planetary gear meshed internally. The working chambers arranged in the cylinder corners in the form of recesses are shaped as pent-roof chambers, thus allowing to obtain an efficient fuel combustion process as well as an advantageous ratio of the chamber surface area to its volume. In the engine according to Patent Specification No. 48198, it is only some of the cylinder walls that are in direct contact with the rotary piston, and this circumstance defines the locations of the elements (segments) in the cylinder (stator) walls to separate the working chambers from each other.

The segments (movable elements) arranged on the working portions of the stator are pressed against the rotor-piston under the influence of gas pressure communicated from the working chamber to the rear surface of the segment (facing the outer wall of the stator). The pressure is communicated from various places of the working chamber via appropriate channels in the stator wall, said channels being located so that the force pressing the segment to the rotor varies step by step when the rotor is in motion, and depends upon its position. The segments feature a hollow box-type desing and have a cooling system.

The kinematics of the rotor-piston motion is defined by two centrodes: a moving centrode establishing the locus of rotation centres for the cross-section of the rotor-piston in the plane of motion, and a fixed centrode determining the locus of instantaneous centres of rotation in a fixed plane. With a definite ratio between the geometrical dimensions of the shaft eccentricity and the number of gear-wheel and pinion teeth, the shape is determined for the side surface of the stator. The motion of the rotor-piston takes place in constant contact with the working sections of the stator so as to define working chambers of variable volume similar to combustion chambers of a piston engine.

In the simplest cases, the sealing between the rotor and the stator is ensured by pressing the side surface of the rotor to the side surface of the stator, and this results in eliminating the disadvantages of the known engines of Wankel type, as related to vibrations and accelerated wear of the sealing members arranged in the rotor-piston. Furthermore, the rotor moves relative to the stator so that undesirable sliding friction is partially replaced by rolling friction—a factor which reduces mechanical losses. For the proto-type machine, owing to the symmetrical location of the working chambers in the stator corners, also typical is a more uniform distribution of forces resulting from the pressure of working medium and acting on the rotor-piston and more specifically, on its shaft so that the diameters of the shaft and bearings can be reduced.

In the above-mentioned Polish patents, there are two embodiments of invention. According to one of the embodiments, the stator is shaped in its cross-section as an equilateral triangle, and in this case the ratio of the moving centrode diameter to the fixed centrode diameter is 2:3, whereas the height of the above-mentioned triangle is more than nine times the magnitude of eccentricity E.

According to the other embodiment, the stator is shaped in its cross-section as a square (one of regular polygons), and in this case the ratio of the moving centrode diameter to the fixed centrod diameter is 3:4, whereas the length of the square side is equal to or larger than sixteen times the magnitude of eccentricity E.

Also, such an embodiment of the above-mentioned arrangement is possible which has a stator shaped as a regular polygon with more than 4 corners.

However, in the arrangement according to the above-mentioned Polish patents, in the embodiment thereof having a triangular stator and a two-vertex rotor it is impossible to place the above-mentioned toothed gearing inside the rotor and stator in order to ensure the rotation of the rotor around the eccentric portion of the shaft. The gearing dimensions that are required will not allow to do this. That is why such an arrangement with a triangular stator and with a gearing inside its rotor cannot be implemented. At the same time, it is exactly this arrangement with a triangular stator that in many cases is preferable for obtaining better characteristics, for instance, specific power per volume unit.

The rotor in an arrangement according to the above-mentioned Polish patents is rotating at a rather high speed. Along with this, the above-mentioned sealing segments have a rather heavy weight. Pressure on the rear surface of the segment varies in steps, said pressure variation "steps" being sufficiently large. This leads to variability of pressure between the stator and rotor at the point of their contact and, therefore, either to poor sealing or to rapid wearing of the surfaces of rotor and segment because of high pressure at the point of their contact.

The rotor design proposed in the prototype does not contain a cooling system for the rotor working under heavy-duty thermal conditions. This does not allow to work at high compression ratios and develop high specific power per volume unit, although in principle the shape proposed for the stator and rotor allows to do this.

At first, the concept of invention is considered for the embodiment of this invention having a triangular stator with the use of which it is possible to obtain a power plant with the highest specific power per volume unit. In order to create such a version of the power plant, it is necessary to place the toothed gearing which serves for ensuring the rotation of the rotor-piston around the eccentric portion of the shaft, beyond the internal space of the rotor and stator, i.e. within the internal space of the stator, since the dimensions of the toothed gearing required do not allow to dispose it inside the rotor-piston.

The concept of this invention according to the first version thereof consists in that a power plant comprises a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having three working sections in constant contact with the rotor-piston, segments which are arranged on the working sections of the side wall of the stator, a toothed gearing in the form of a pinion connected to the rotor-piston and of an internal gear-wheel rigidly connected to the stator, wherein each cross-section of the rotor-piston side surface that is perpendicular to the axis of the eccentric portion of the shaft, represents a convex line having two points that are most distant from the axis of the eccentric potion of the shaft and disposed symmetrically thereto, each cross-section of the stator side wall that is perpendicular to the axis of the shaft is shaped as a regular triangle with straight or smoothly convex lines of its sides, the internal space of the stator is divided into three working chambers of variable capacity by the lines of contact between the convex side surface of said rotor-piston and the three working sections of the stator.

In the distinction to the prototype, the power plant has a bushing of external diameter d rigidly connected to the rotor-piston, in the end wall of the stator there is a circular opening which is coaxial with the shaft and has a diameter larger than E+0.5d, where E=distance between the axis of said shaft and the axis of said eccentric portion thereof, a rotary disk is mounted in said opening coaxially with the shaft, the bushing reaches beyond the internal space of the stator and extends through an opening in the rotary disk, the pinion of said toothed gearing is connected rigidly to the bushing and is coaxial therewith, said toothed gearing is placed in the stator beyond the internal space thereof, and an annular sealing is mounted between the stator and the rotary disk.

In distinction to the prototype, in the embodiment where the rotor-piston works under heavy thermal loads and in particular, in engines, in order to cool the rotor-piston, the internal cavity of the rotor-piston is made as a set of closed channels arranged under the side surface of the rotor-piston, and a pressure and a drain manifolds of forced cooling, wherein the sections of the closed channels that are most distant from the axis of the eccentric portion of the shaft are connected to the pressure manifold, and the sections of the closed channels that are nearest to the axis of the eccentric portion of the shaft are connected to the drain manifold.

In distinction to the prototype, in another embodiment where the rotor-piston also works under heavy thermal loads and in particular, in engines, in order to cool the rotor-piston, the internal cavity of of the rotor-piston comprises a set of closed channels arranged under the side surface of the rotor-piston, and a pressure and a drain manifolds of forced cooling, wherein the sections of the closed channels that are least distant from the axis of the eccentric portion of the shaft on one side of the rotor-piston side surface relative to said axis are connected to the drain manifold, and the sections of the closed channels that are least distant from the axis of the eccentric portion of the shaft on the other side of the rotor-piston side surface relative to said axis are connected to the pressure manifold.

The above-mentioned two embodiments of forced cooling for the rotor-piston are utilized depending upon what parts of the rotor-piston work under heavier thermal conditions, and this depends on the order in which the phases of the working process are alternating in the combustion chambers, as will be explained below.

In distinction to the prototype, the rotor-piston can be made as a body and a finned shell, said shell fins being supported by the body so as to define closed channels. Such a design of the rotor ensures efficient removal of heat from the rotor surface.

In distinction to the prototype, in an embodiment where it is necessary to ensure a more efficient sealing between the working chambers, each segment located on the working section of the stator side surface comprises a set of unloaded sealing members and spring members, said sealing members being capable of limited movement towards the internal space of the stator while being in contact with the end walls of the stator, various combinations of said sealing members are in contact with the side surface of the rotor at different orbital positions of the rotor-piston, and points throughout the entire length of at least one sealing member in each segment are in contact with the side surface of the rotor-piston.

A segment can be made as a cartridge having a holder with fins and slots facing the internal space of the stator and disposed with a predetermined pitch on said working sections so as to extend in the direction from one end wall of the stator to the other end wall thereof, means for fixing said sealing members, a flange connected to the holder and disposed outside the internal space of the stator and provided with heat-removal elements, a mounting surface with a sealing between the stator and the cartridge, said sealing members and said spring members which are in contact with them being disposed in the slots between the holder fins.

In one of the embodiments, said sealing members and said holder fins have openings extending therethrough, and said means for fixing said sealing members is made as a bar inserted in said openings extending therethrough.

Making the sealing with the use of several unloaded and spring-loaded sealing members allows to ensure the desired predetermined pressure exerted by the sealing member on the surface of the rotor and determined basically by the force of the spring member. This allows to extend the service life of the sealing members and ensure high quality of sealing.

In a further embodiment, the bushing and pinion are connected with one another by means of a splined joint, the pinion splines being made as extensions of its teeth.

Next, the essential features of this invention are described for embodiments not with a triangular but with a polygonal stator having at least four corners. In these embodiments, the toothed gearing between the rotor and stator can be disposed inside the rotor, like in the prototype. In this case, the power plant comprises a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon with N corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity.

In distinction to the prototype, in case if it is necessary to ensure a higher efficiency of the sealing between the stator and rotor (for instance, in an engine), in a power plant with a polygon shape of its stator (the number of corners being at least 4) each segment must contain a set of unloaded sealing members and spring members, said sealing members being capable of limited movement towards the internal space of the stator and back while being in contact with the end walls of the stator, various combinations of said sealing members are in contact with the side surface of the rotor at different orbinal positions of the rotor-piston, and points throughout the entire length of at least one sealing member in each segment are in contact with the side surface of the rotor-piston.

In one of its embodiments, the polygonal rotor-piston of the power plant comprises a cooling system which is made as a set of closed channels arranged under the side surface of the rotor-piston, and a pressure and a drain manifolds of forced cooling, wherein the sections of the closed channels that are most distant from the axis of the eccentric portion of the shaft are connected to the pressure manifold, and the sections of the closed channels that are nearest to the axis of the eccentric portion of the shaft are connected to the drain manifold.

In one of the embodiments with a polygonal stator, the rotor-piston comprises a body and a finned shell, said shell fins being supported by the body so as to define said channels.

In a further one of the embodiments with a polygonal stator, the segment is made as a cartridge having a holder with fins and slots facing the internal space of the stator and disposed with a predetermined pitch on said working sections so as to extend in the direction from one end wall of the stator to the other end wall thereof, means for fixing said sealing members, a flange connected to the holder and disposed outside the internal space of the stator and provided with heat-removal elements, a mounting surface with a sealing between the stator and the cartridge, said sealing members and said spring members which are in contact with them being disposed in the slots between the fins.

In another embodiment with a polygonal stator, said sealing members and said holder fins have openings extending therethrough, and said means for fixing said sealing members is made as a bar inserted in said openings extending therethrough.

In an embodiment with a polygonal stator (the number of corners being at least 4), in order to simplify the rotor design, the toothed gearing between the rotor and stator, in distinction to the prototype, is placed outside the rotor. The opening which is made in the wall of the stator in order to dispose the gearing of the rotor with the stator beyond the rotor may not be closed with a rotary disk or ring if the rotor-piston during its rotation and in any position thereof has its end wall to overlap said opening in the stator. In this case, the power plant comprises a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon with N corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity.

It should be pointed out that the corners in the cross-section of the stator side wall, which are mentioned above, may be rounded off or have another shape as required to ensure efficient burning.

In distinction to the prototype, in the embodiment now described there is a bushing of external diameter d rigidly connected to the rotor-piston, in the end wall of the stator there is an opening, the distance from any point of the stator wall in said opening to the axis of the shaft is larger than E+0.5d and smaller than the distance from the axis of the eccentric portion of the shaft to the point of the rotor-piston side surface that is nearest to the axis of the eccentric portion of the shaft minus E, where E=distance between the axis of said shaft and the axis of said eccentric portion of the shaft, the bushing reaches beyond the internal space of the stator and extends through said opening in the end wall of the stator, the pinion of said toothed gearing is connected rigidly to the bushing and is coaxial therewith, said toothed gearing being disposed in the stator wall or beyond it outside the internal space of the stator.

In one of the embodiments with a polygonal stator (the number of corners being at least 4), in order to simplify the rotor design, the toothed gearing between the rotor and stator, in distinction to the prototype, is placed outside the rotor. The opening which is made in the wall of the stator to dispose the gearing of the rotor with the stator beyond the rotor may be closed (completely) with a rotary disk or (partially) with a rotary ring, and in this case, the power plant comprises a shaft with an eccentric portion, a rotor-piston mounted on the eccentric portion of the shaft and having an internal cavity and external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon with N corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity.

In distinction to the prototype, the power plant has a bushing of external diameter d rigidly connected to the rotor-piston, in the end wall of the stator there is a circular opening which is coaxial with the shaft and has a diameter larger than E+0.5d, where E=distance between the axis of said shaft and the axis of said eccentric portion thereof, in said opening a rotary disk or ring provided with an annular sealing is mounted coaxially with the shaft, which disk or ring has the external circumference diameter thereof smaller than the diameter of said opening twice the sealing thickness, the bushing reaches beyond the internal space of the stator and extends through an opening in the rotary disk or a recess in the rotary ring, the pinion of said toothed gearing is connected rigidly to the bushing and is coaxial therewith, said toothed gearing is placed in the stator beyond the internal space thereof.

It should be pointed out that the shape of the rotor is described in Polish Patent No. 48198 (column 5, lines 53–54) mentioned above. For instance, for a stator having a cross-section shaped as a square, the rectangular coordinates of the points of the rotor curve have the following values:

$X=\sin A*(8E*\cos^3 A-k)$ $Y=-8E*\cos^4 A+12E*\cos^2 A+k*\cos A-3E$, where A=an independent variable quantity in the parametrical system, k=half a square side of the stator cross-section, and E=eccentricity (the distance between the axis of the power plant shaft and the axis of the eccentric portion of the shaft).

The power plant now claimed will further be described with reference to FIGS. 1 to 31.

FIG. 22, FIG. 23, FIG. 24, and FIG. 25 show various embodiments of the annular sealing of the rotary disk.

Figure 26:
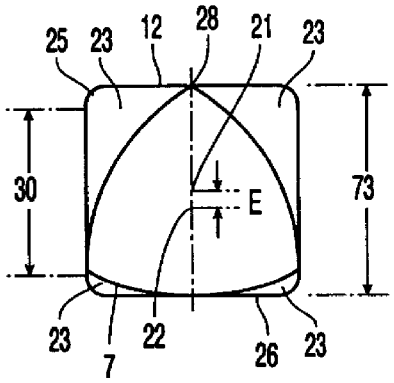
Figure 27:
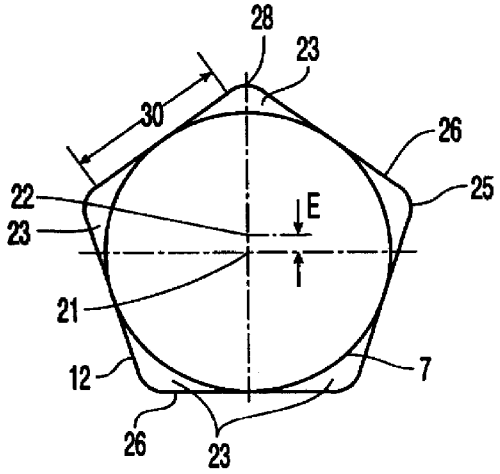
Figure 28:
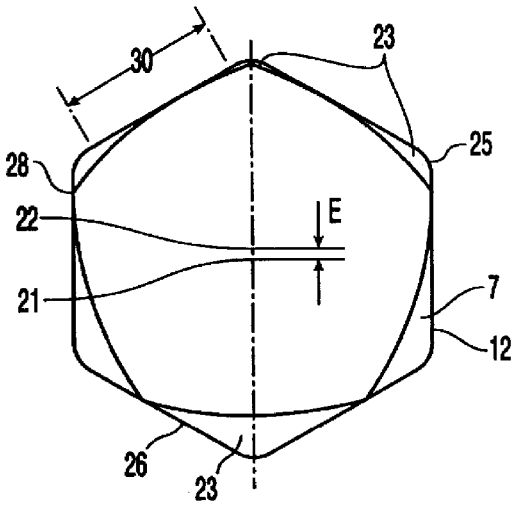

FIG. 26, FIG. 27, and FIG. 28 illustrate schematically cross-sections of various embodiments of the stator and rotor-piston with four, five and six working chambers, respectively.

Figure 29:
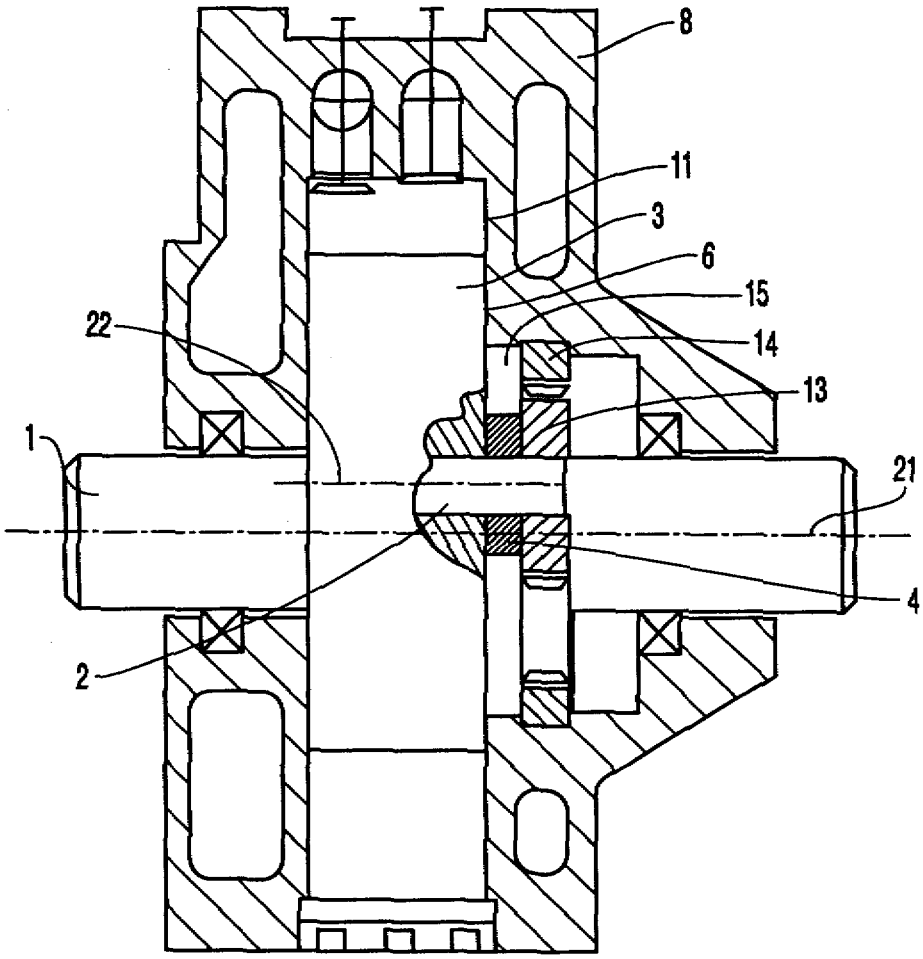

FIG. 29 is a longitudinal sectional view of the arrangement with more than three working chambers (an embodiment of the stator without a rotary disk or ring).

Figure 30:
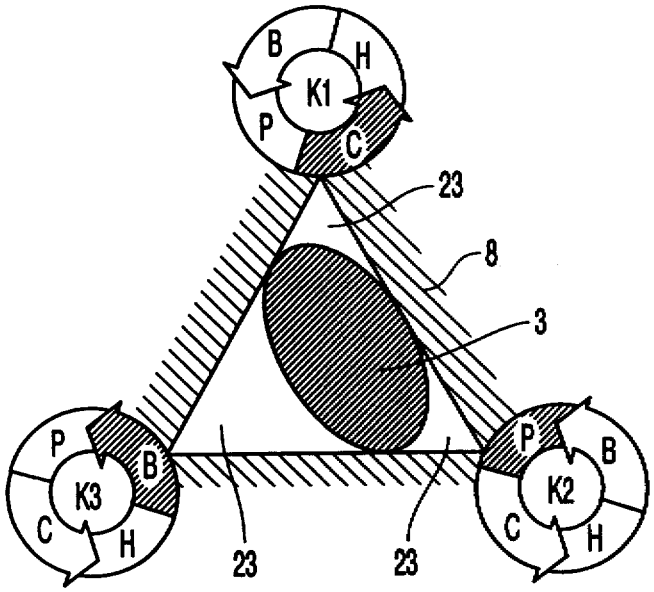
Figure 31:
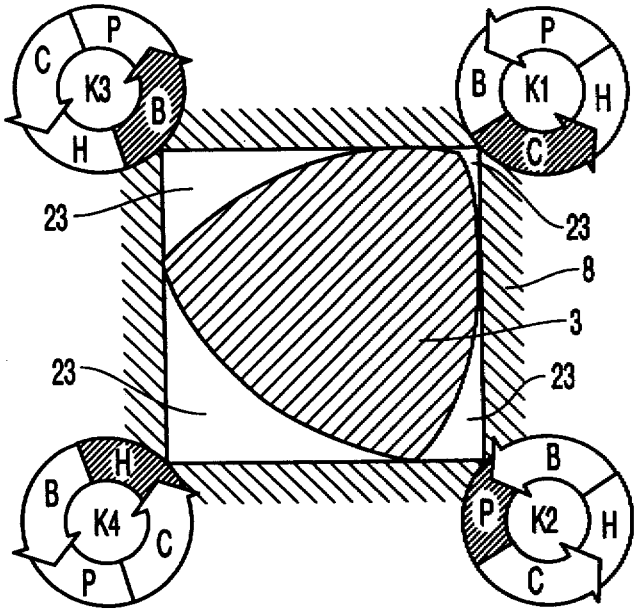

FIG. 30 and FIG. 31 show the diagrams of phases of the working process in the combustion chambers.

NUMERICAL LIST

1—shaft,

2—eccentric portion of the shaft,

3—rotor-piston,

4—bushing,

5—end surface of the rotor-piston,

6—end surface of the rotor-piston,

7—side surface of the rotor-piston,

8—stator,

9—internal space of the stator,

10—end wall of the stator,

11—end wall of the stator,

12—side wall of the stator,

13—pinion connected to the rotor-piston,

14—internal gear-wheel connected to the stator,

15—opening in the end wall of the stator,

16—rotary disk or ring,

17—segment on the side wall of the stator,

18—internal cavity of the rotor-piston,

19—annular sealing of the rotary disk,

20—flywheel,

21—axis of the shaft,

22—axis of the eccentric portion of the shaft,

23—working chamber of variable capacity,

24—distribution mechanism for working medium,

25—rounded-off corner of the stator,

26—straight or convex lines of the stator cross-section sides,

27—height of the triangular stator cross-section,

28—point of the rotor-piston that is most distant from the axis of the eccentric portion of the shaft,

29—line of contact between the side surface of the rotor and the segments,

30—working section of the side wall of the stator,

31—opening for the bushing in the rotary disk,

32—channels for cooling the rotor-piston,

33—external shell of the internal cavity of the rotor-piston,

34—holder,

35—unloaded sealing member,

36—system for initiating the working process,

37—pressure manifold of the cooling system of the rotor-piston,

38—section of the cooling channels that is most distant from the axis of the eccentric portion of the shaft,

39—drain manifold of the cooling system of the rotor-piston,

40—section of the cooling channels that is nearest to the axis of the eccentric portion of the shaft,

41—body of the rotor-piston,

42—fins of the rotor-piston,

43—slots of the holder,

44—stationary sealing between the stator and the cartridge,

45—fixing bar,

46—spring member,

47—flange of the cartridge of sealing members,

48—heat-removal element,

49—mounting surface,

50—cartridge for sealing members,

51—through opening for the fixing bar,

52—pitch of distributing the holder slots,

53—middle of the holder,

54—fins of the holder,

55—working chamber with high pressure of gases,

56—working chamber with low pressure of gases,

57—upper surface of the unloaded sealing member,

58—lower surface of the unloaded sealing member,

59—clearance in the holder slot,

60—side surface of the unloaded sealing member,

61—cross-section of the holder fins,

62—side surface of the fins,

63—cross-section of the sealing member shaped as a trapezium,

64—upper convex portion of the sealing member,

65—extensions of the pinion teeth,

66—internal teeth in the bushing,

67—pinion teeth,

68—thrust bearing,

69—conical section of the annular insert,

70—elastic ring,

71—labyrinth sealing of the annular insert,

72—separate sectors of the annular insert,

73—side of the square in the cross-section of the stator (N=4)

Figure 1:
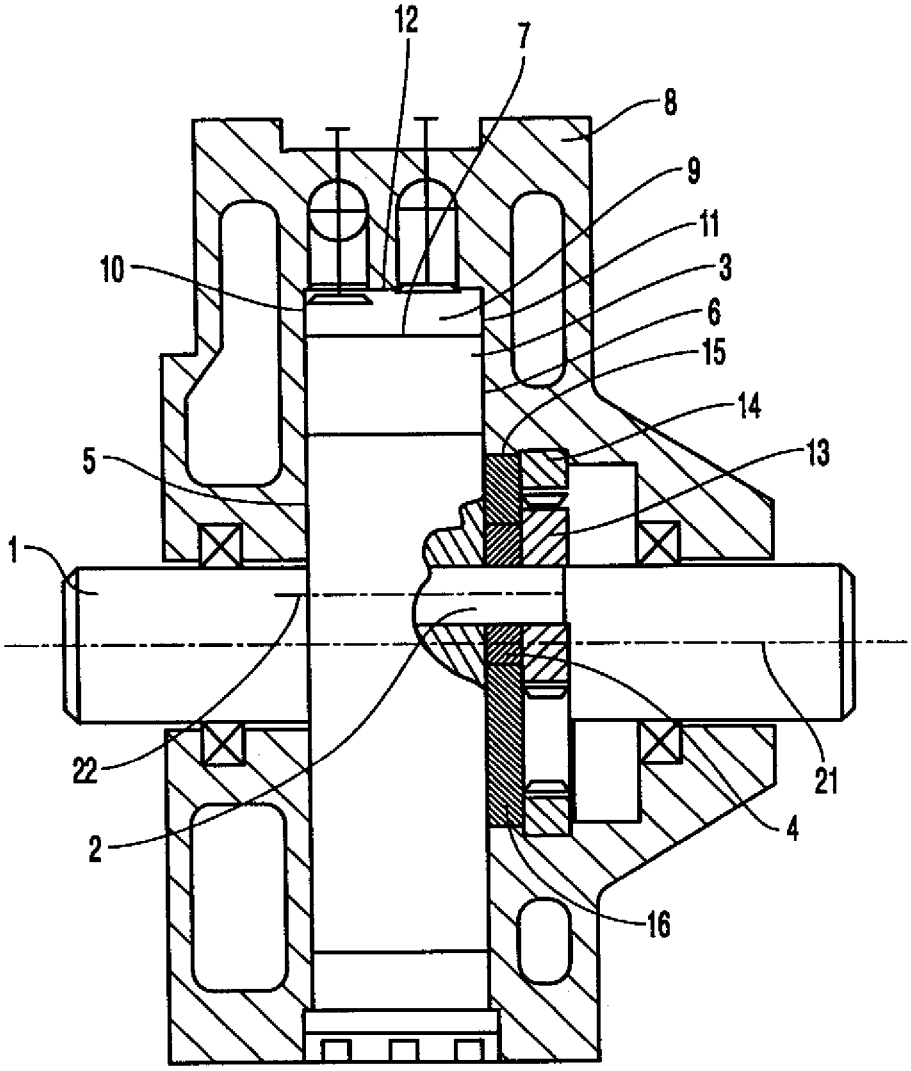
FIG. 1 is a longitudinal sectional view of the arrangement (along the axis of the shaft).
Figure 2:
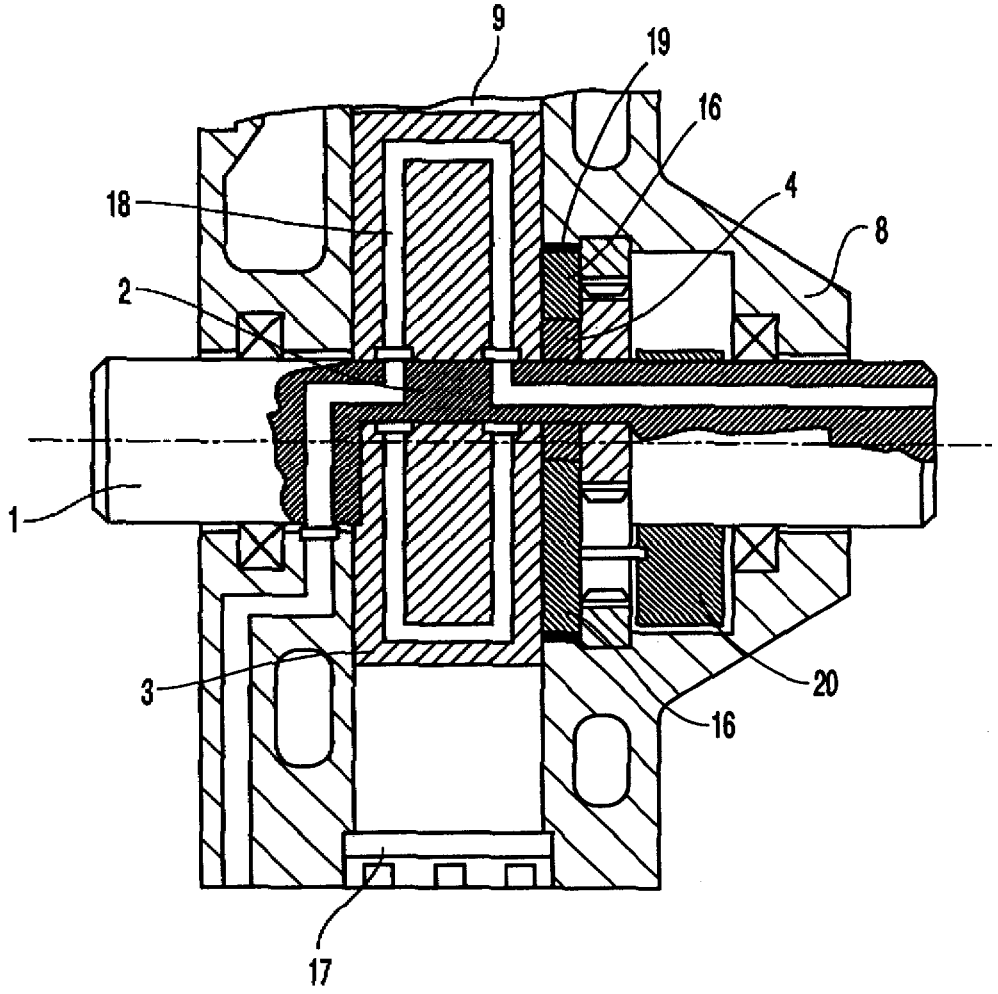
FIG. 2 is a longitudinal sectional view of an embodiment of the arrangement with a flywheel.

FIG. 1 and FIG. 2 show a power plant according to this invention. As an example, arrangement of a rotary-piston internal combustion engine is described which has at least one section to which similar sections can be connected at its end sides. Particularities of arrangement of a pump and a compressor made in accordance with this invention will be described below. The power plant comprises:

a shaft 1 supported in bearings and having an eccentric portion 2, a rotor-piston 3 mounted rotatably on the eccentric portion 2 and having an internal cavity 18 and which has its external surface made up of end surfaces 5, 6 and a convex side surface 7, a stator 8 which has its internal space 9 intended to receive the rotor-piston therein and defined by two flat parallel end walls 10, 11 and a closed side wall 12.

PREFERRED EMBODIMENT OF THE CLAIMED POWER PLANT (WITH A TRIANGULAR STATOR AND A TWO-VERTEX ROTOR-PISTON)

Figure 3:
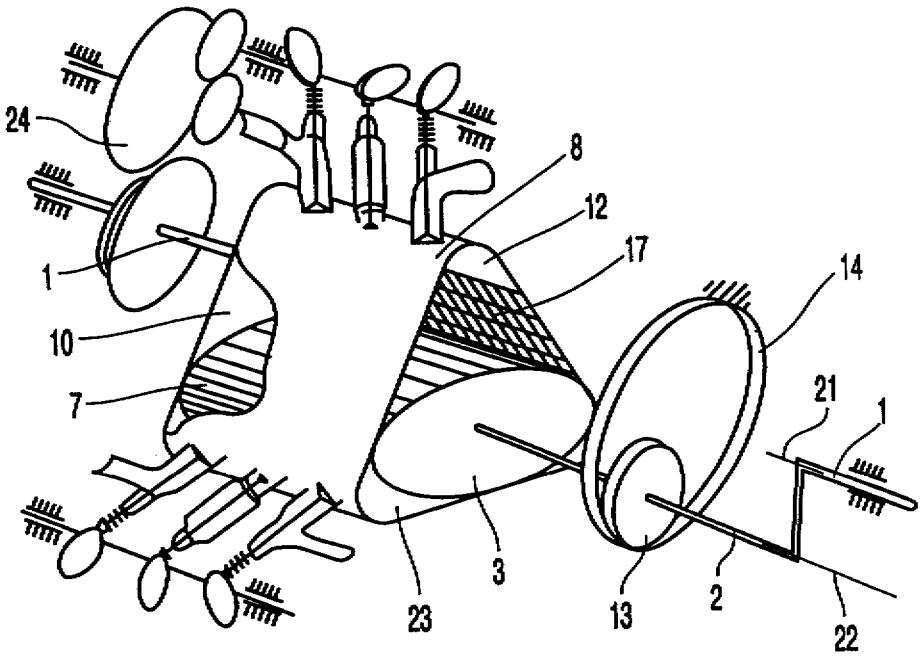
FIG. 3 illustrates the schematic diagram in a perspective view for the arrangement with a two-vertex rotor-piston.
Figure 4:
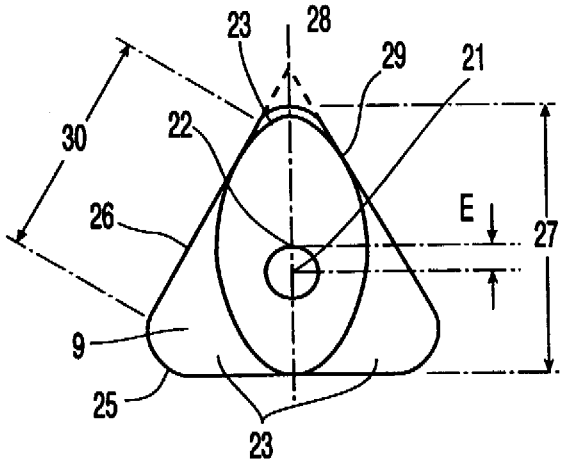
FIG. 4 illustrates schematically a cross-section of the stator and rotor-piston (perpendicularly to the axis of the shaft) for the arrangement with a two-vertex rotor-piston.

On the side wall 12 of the stator 8 (FIG. 3), there are three separating members—segments 17. Each of the three segments 17 is in constant contact with the side surface 7 of the rotor-piston 3, thus dividing the internal space of the stator 8 into three working chambers 23. Each cross-section of the side wall 12 of the stator (FIG. 4) that is perpendicular to the axis 21 of the shaft is shaped as a regular triangle with rounded-off corners 25 and with straight or smooth convex lines 26 of its sides, which has its geometrical parameters related to a value of the distance E between the axis 21 of the shaft 1 and the axis 22 of the eccentric portion 2 of the shaft. The height 27 of this regular triangle is larger than nine times the value of the distance E. The cross-section of the side surface of the rotor-piston 3 that is perpendicular to the axis 22 of the eccentric portion 2 of the shaft, represents a closed convex line having two points 28 that are most distant from the centre 22 of the rotor-piston (in FIG. 4 this centre is a projection of the axis 22 of the eccentric portion of the shaft on the cross-section plane). The shape of the side surface 7 (FIG. 3) of the rotor-piston 3 is such that it is in constant contact with all the three sides of the side wall 12 of the triangular stator. The internal space 9 of the stator is divided into three working chambers 23 of variable capacity by lines 29 of contact between the convex side surface of the rotor-piston 3 and the three segments 17 which are the working sections 30 of the stator.

The rotor-piston 3 (FIG. 1 and FIG. 2) has a bushing 4 made integral with it and coaxial with the eccentric portion 2 of the shaft or is rigidly connected to such a bushing. The busing 4 rotates together with the rotor-piston on the eccentric portion 2 of the shaft, it is disposed outside the internal space 9 of the stator 8 and has an external diameter d. A pinion 13 connected rigidly to the bushing 4 and coaxial with it is in engagement with a gear-wheel 14 which has internal teeth and is connected rigidly to the stator 8. The ratio of the diameter of the pinion 13 to the diameter of the gear-wheel 14 is equal to 2:3.

It should be pointed out that the above-mentioned bushing 4 can be made as a protruding part of the rotor-piston 3 or it can be a separate part connected rigidly by one or another method to the rotor-piston 3. The same holds true for the rigid connection of the bushing 4 to the pinion 13, i.e. it can be made as a protruding part of the pinion or as a separate part connected to it.

Figure 5:
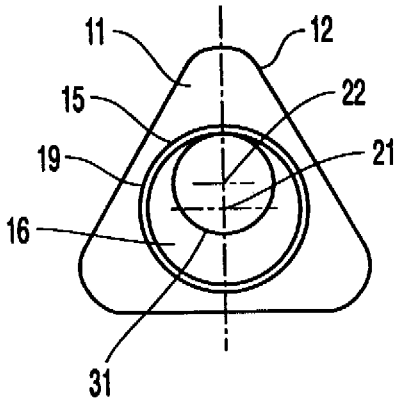
FIG. 5 illustrates the front end wall of the stator for the arrangement with a two-vertex rotor-piston.

FIG. 5 shows a front end wall 11 of the stator 8. This wall has an opening 15 which has its axis in alignment with the axis 21 of the shaft 1. The diameter of this opening is larger than the value of E+0.5d. A rotary disk 16 closing completely the opening 15 is placed inside the opening 15 so as to be capable of rotating relative to the wall 11. Instead of the disk, a ring can be installed which closes the opening 15 only partially. The external (cylindrical or conical) surface of rotation of the rotary disk (or ring) 16 bears against a corresponding portion of the opening 15. An annular sealing 19 is placed between the disk (or ring) 16 and the wall 11 of the stator. The disk (or ring) 16 is provided with an opening 31 or a recess for the bushing 4 to extend therethrough.

The power plant may have a flywheel 20 rigidly connected to the shaft 1 (FIG. 2). The flywheel 20 can be also connected with the rotary disk or ring 16 as well.

Figure 6:
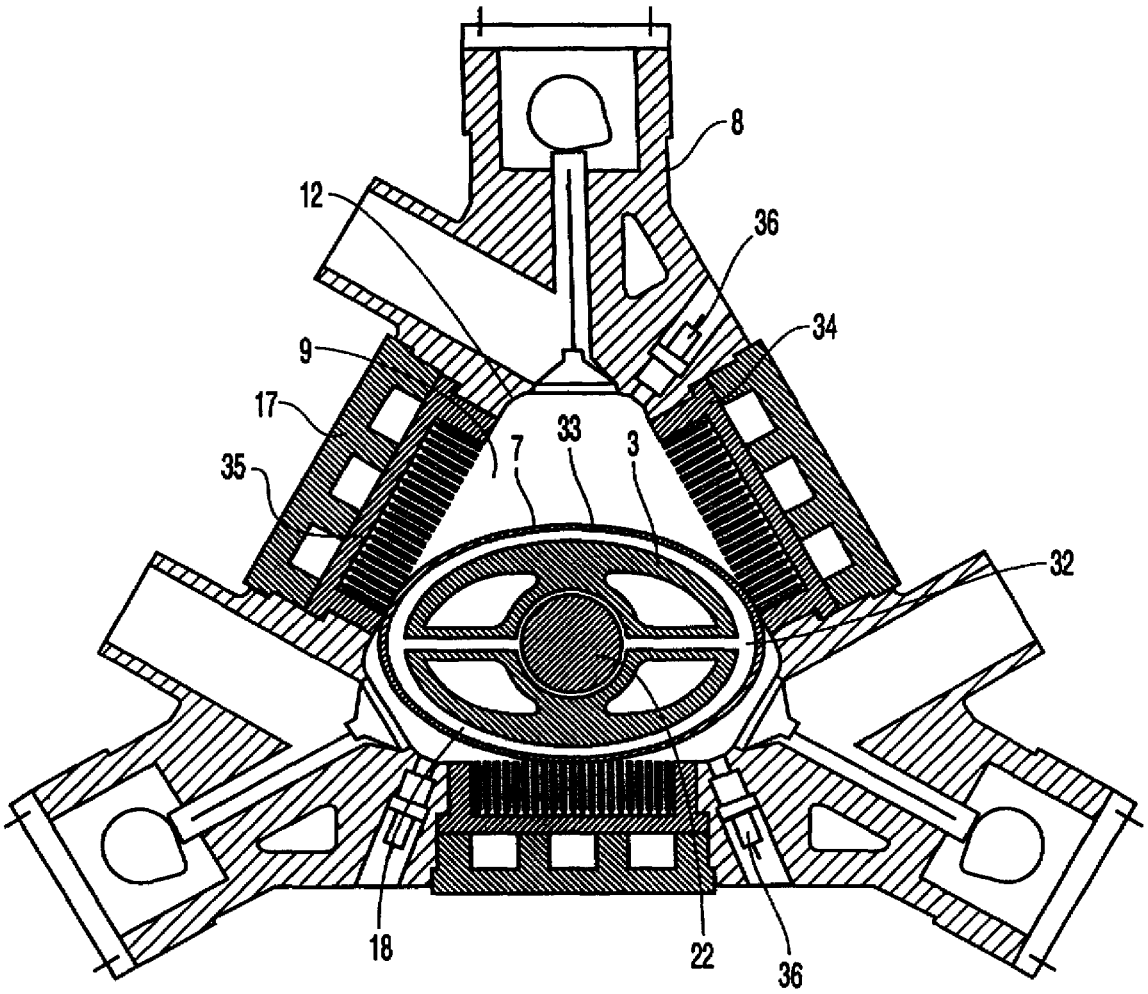
FIG. 6 is a lateral sectional view of the arrangement with a two-vertex rotor-piston.

FIG. 6 shows a lateral sectional view of the stator 8 and the rotor-piston 3. The internal cavity 18 of the rotor-piston 3 constitutes a set of channels 32 for cooling that are arranged under the shell 33, the external surface of which is simultaneously the side surface 7 of the rotor-piston. The channels 32 are connected to the pressure and drain manifolds of the cooling system. In FIG. 2 it is shown that the internal cavity 18 of the rotor-piston 3 is connected with the coolant supply channels extending inside the shaft 1 and the stator 8. FIG. 6 shows also the segments 17 arranged on the side wall wall 12 of the stator 8. Each of the segments 17 contains a set of unloaded scaling members 35 secured in the holder 34. In addition to this, a system 36 for initiating the working process is shown which is made to consist of spark plugs. It has nothing to differ it from the systems for initiating the working process which are generally used in internal combustion engines.

Figure 7:
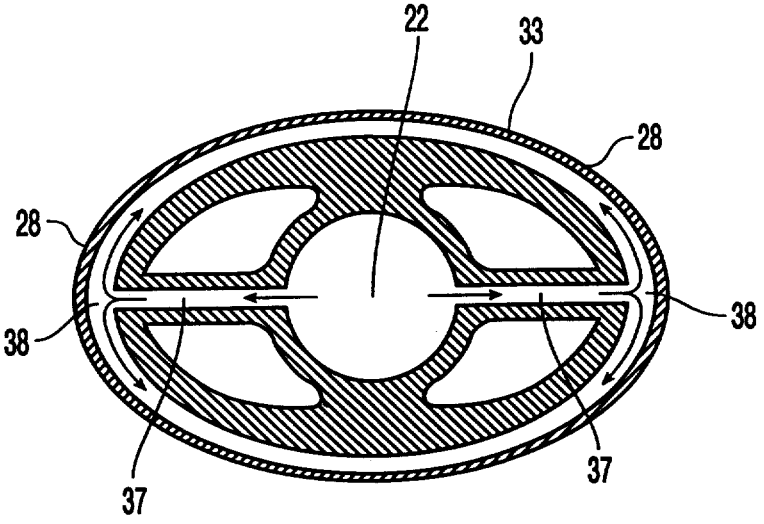
FIG. 7 is a cross-section of the two-vertex rotor-piston as passed through the pressure manifolds of the cooling system.

FIG. 7 shows a cross-section of the rotor-piston, which is perpendicular to the axis 22 of the shaft 1 and is made through the pressure manifolds 37 of the cooling system. The sections 38 of the cooling channels 32 that are most distant from the axis 22 and are located in the vicinity of the points 28 that are most distant from the centre of the rotor-piston cross-section are connected to the pressure manifolds 37. And the sections 40 (FIG.1 8) of the cooling channels that are nearest to the axis 22 are connected to the drain manifolds 39.

Figure 9:
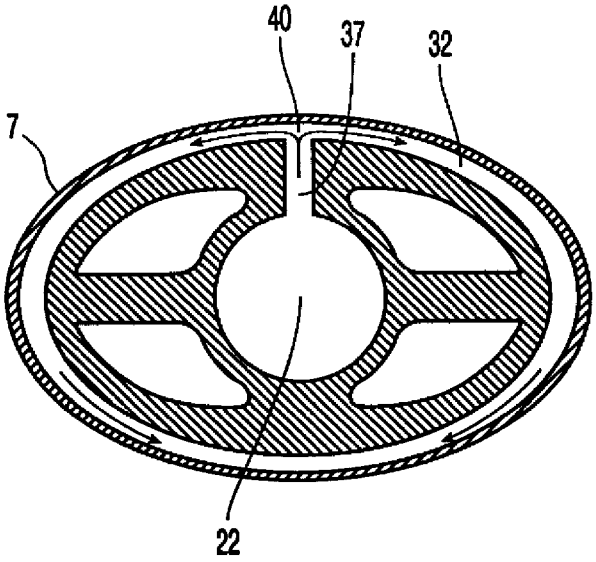
FIG. 9 is a cross-section of the two-vertex rotor-piston as passed through the pressure manifold of the cooling system (another embodiment).

FIG. 9 shows a second embodiment of the two-vertex rotor-piston 3. The cross-section that is perpendicular to the axis 22 of the shaft 1 is made through the pressure manifolds 37 of the cooling system. The section 40 of the closed channels 32 that is least distant from the axis 22 of the eccentric portion 2 of the shaft on one side of the side surface 7 of the rotor-piston 3 is connected to the pressure manifold 37.

Figure 10:
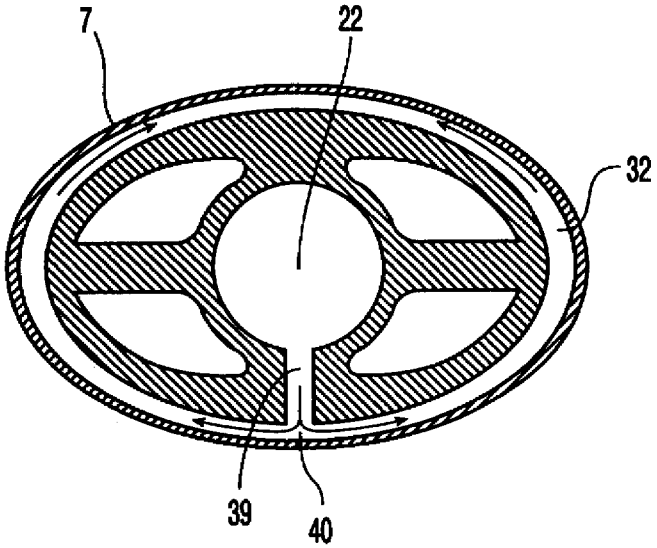
FIG. 10 is a cross-section of the two-vertex rotor-piston as passed through the drain manifold of the cooling system (another embodiment).

FIG. 10 shows a cross-section of the two-vertex rotor-piston 3 made through the drain manifolds 39 of the cooling system (for the above-mentioned second embodiment). The section 40 of the closed channels 32 that is least distant from the axis 22 of the eccentric portion 2 of the shaft on the other side with respect to the section shown in FIG. 9, of the side surface 7 of the rotor-piston 3 is connected to the drain manifold 39 of the cooling system.

Figure 12:
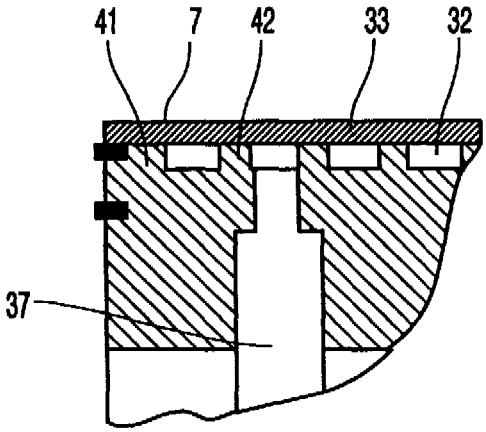
FIG. 12 is a fragment of a longitudinal section of the rotor-piston (another embodiment of the rotor-piston shell).

The cooling channels 32 may represent a rather narrow slit defined by body 41 of the rotor-piston (FIG. 1) and the shell 33 supported by it, said slit being divided into separate channels by fins 42. These fins may be integral with the shell 33. In another embodiment (FIG. 12), the fins 42 are parts of the body 41 of the rotor-piston, whereas the shell 33 is made smooth on its external and internal sides.

Figure 13:
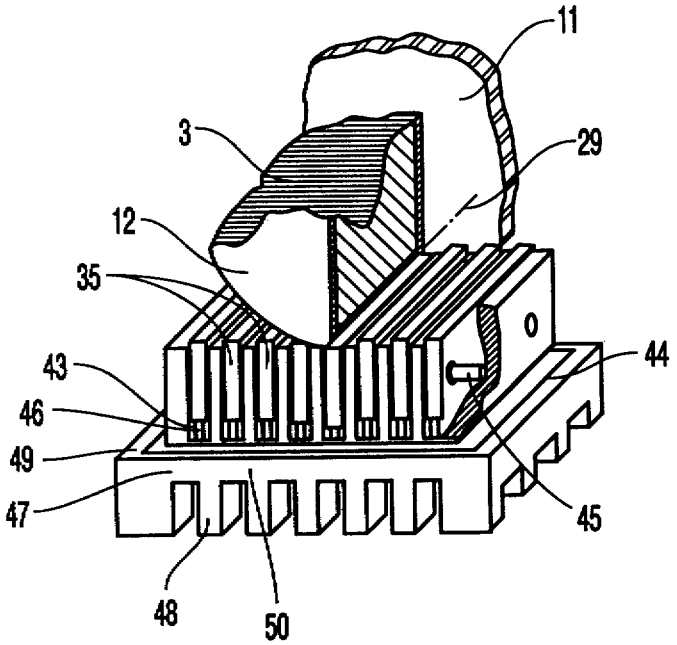
FIG. 13 illustrates a cartridge with sealing members in a perspective view and a fragmentary sectional view of the rotor-piston.

FIG. 13 shows a perspective view of the cartridge 50 containing a set of unloaded sealing members 35, the length of which in the direction perpendicular to the end wall 11 of the stator is equal to the distance between the end walls 10 and 11. The members 35 have their end sides in contact with the walls 10 and 11 of the stator.

Figure 14:
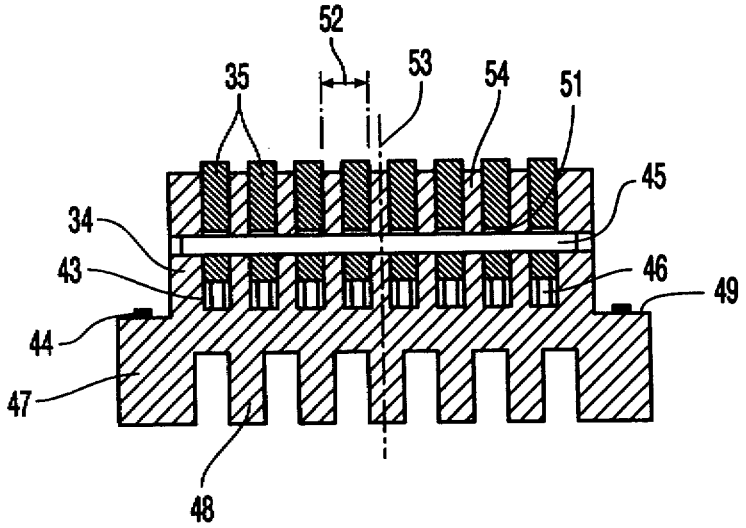
FIG. 14 is a sectional view of the cartridge with sealing members and means for fixing the sealing members.

FIG. 14 shows a sectional view of the cartridge 50, the main part of which is a holder 34 having a comb-like structure consisting of alternating fins 54 and slots 43. The slots (and the fins) of the holder are perpendicular to the direction of rotation of the rotor-piston 3. The slots are disposed with a predetermined pitch 52 which can be constant or variable and depend upon the location of the slot on the holder 34. The sealing members 35 are made to be unloaded and may have a plate form. They are disposed in the slots 43 and are movable in the direction towards the side surface 12 of the rotor-piston 3 placed in the internal space 9 of the stator. In order to retain them in the slots 43, use is made of means for fixing the sealing members. In the slots between the holder and the sealing members 35, spring members 46 are placed. The cartridge 50 has, besides the holder 34, also a flange 47 connected to the holder and facing, with respect to the holder, the side opposite to the internal space 9 of the stator. The flange 47 is provided with heat-removal elements 48, for instance, in the form of a system of projections. The mounting surface 49 is on the flange 47 (but is may also be located on the holder 34), it bears against the body of the stator 8 and has a stationary sealing 44 for sealing the internal space 9 of the stator. The purpose of the mounting surface 49 is to install the cartridge 50 in its working position on the stator 8. In addition to this, FIG. 14 shows one of the embodiments of the fixing means: a fixing bar 45 extends through openings 51 in the fins 54 and in the sealing members 35. The pitch 52 of distributing the slots can be predetermined so that it will vary from the middle 53 of the cartridge to the edges thereof.

Figure 15:
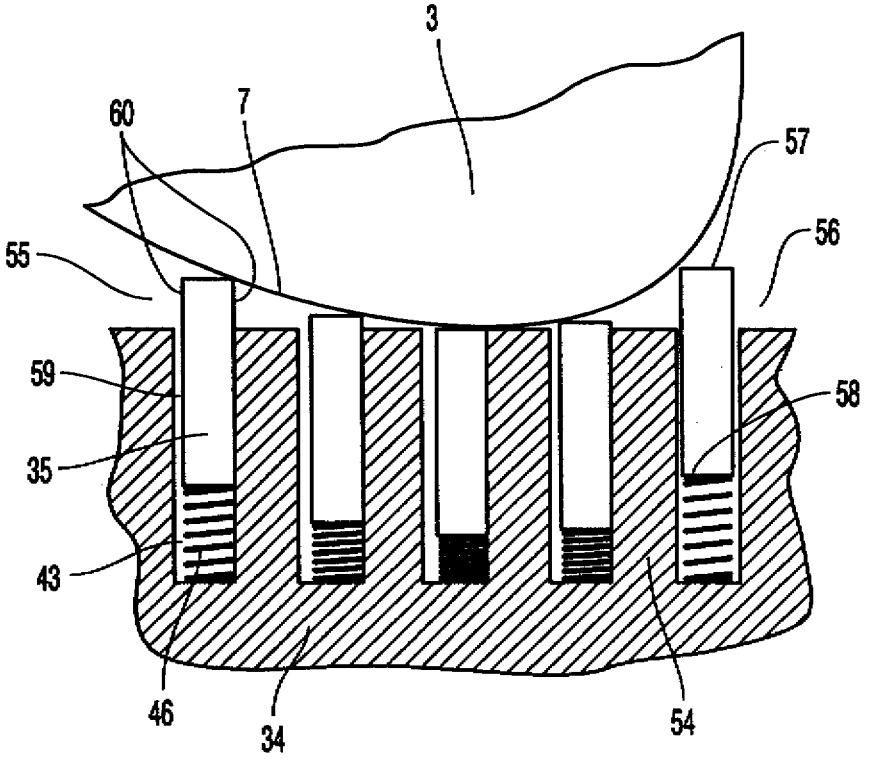
FIG. 15 is a fragment of the cartridge with sealing members (in a sectional view) and the rotor-piston.

FIG. 15 shows a fragment of the holder 34 for a cartridge with with floating sealing members 35, and a rotor-piston 3 which is in contact with them. The side surface 7 of the rotor-piston 3 is in contact with several unloaded sealing members 35. The working chamber 55 with high pressure of gases therein is separated by the sealing members 35 from the working chamber 56 with low pressure of gases therein. The sealing members 35 are disposed in the slots 43 of the holder 34. The spring members 46 (shown in FIG. 15 schematically) are inserted between the sealing members 35 and the lower surface of the slot 43. Means for fixing is not shown. The upper surface 57 of the unloaded sealing member 35 is in contact with the surface 7 of the rotor-piston. The spring 46 is pressed against the lower surface 58 of the sealing member 35. The clearance 59 in the slot 43 is defined between the fin 54 of the holder and the side surface 60 of the unloaded sealing member 35.

Figure 16:
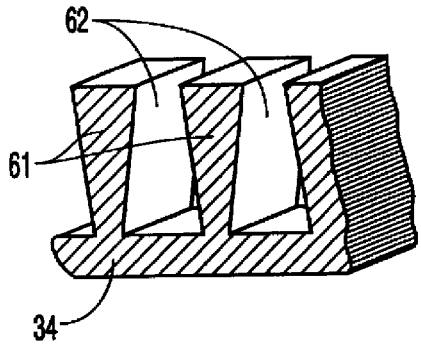
FIG. 16 is a section of cartridge holder fins having a trapezoidal shape.

FIG. 16 shows a cross-section 61 of the holder fins, which is shaped as a trapezium which has its smaller base to bear against the holder 34.

Figure 17:
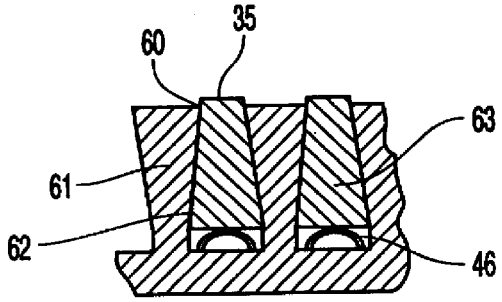
FIG. 17 is a section of holder fins of trapezoidal shape and corresponding sealing members.

In FIG. 17, the sealing member 35, the cross-section 63 of which is also shaped as a trapesium, can move to enter the internal space of the stator at a fixed height limited by seating the side surface 60 of the sealing member 35 against the side surface 62 of the holder fins.

Figure 18:
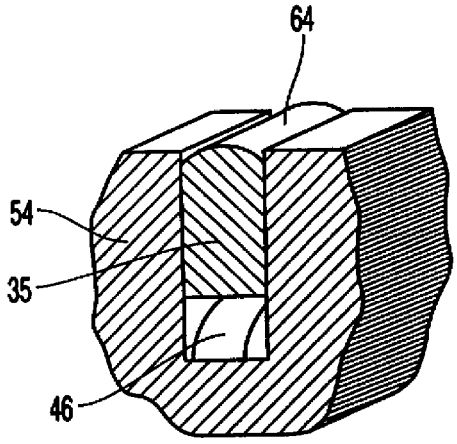
FIG. 18 shows fragments of holder fins and an embodiment of sealing members having a convex surface (the fixing means is not shown).

FIG. 18 shows a sealing member 35 having a convex upper portion 64 (directed towards the internal space of the stator.)

Figure 19:
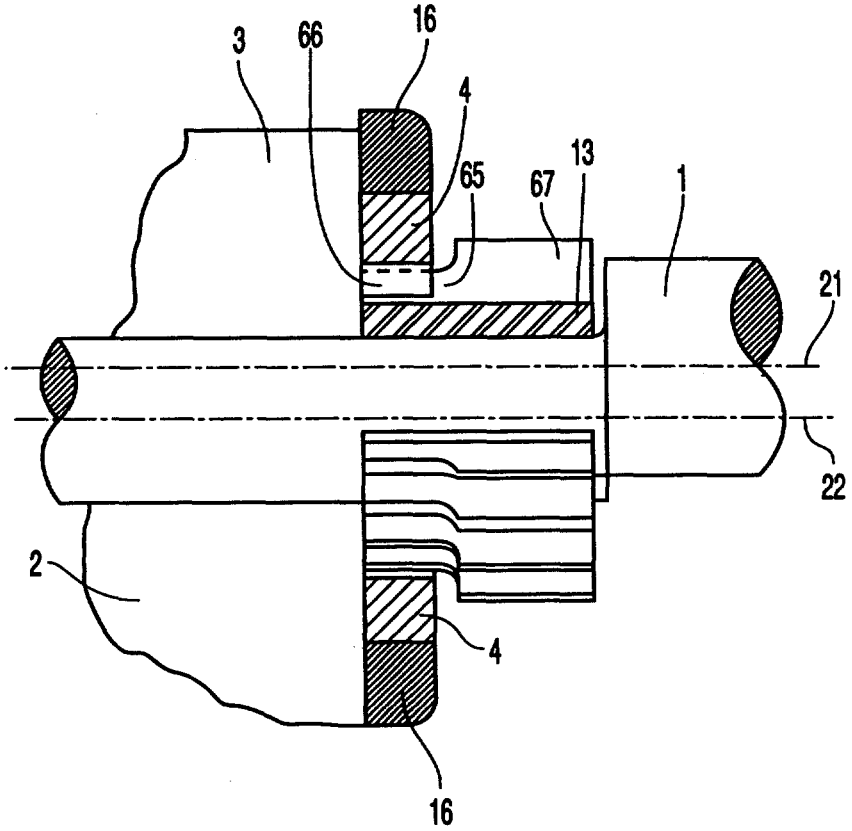
FIG. 19 shows a splined joint of the pinion to the bushing.
Figure 20:
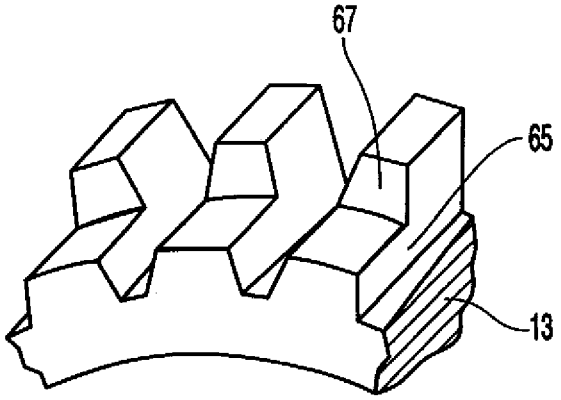
FIG. 20 is a fragment of the pinion with appropriate sections turned in its teeth for the splined joint of the pinion.

FIG. 19 shows an alternative connection of the pinion 13 to the bushing 4 which is rigidly connected to the rotor-piston 3. Over some section, the teeth 67 of the pinion 13 are turned around the external diameter thereof (as it is shown in FIG. 20), their extensions 65 engage with the corresponding teeth 66 of internal mesh in the bushing 4, thus forming a splined joint with them.

Figure 21:
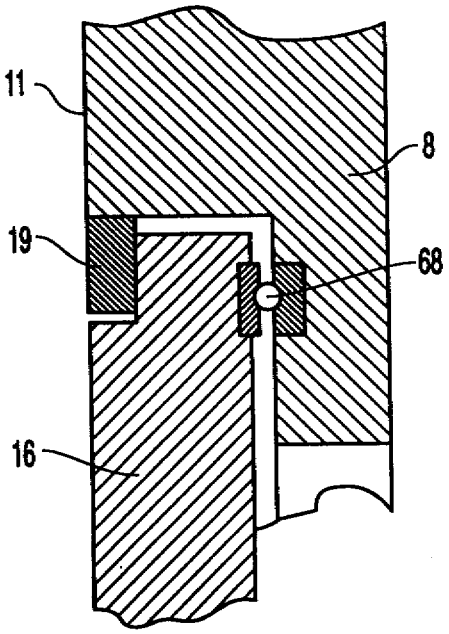
FIG. 21 is an embodiment of an annular sealing of the rotary disk with a thrust bearing.

FIG. 21 shows an embodiment of a movable connection of the rotary disk (or ring) 16 to the wall 11 of the stator 8. A thrust bearing 68 is mounted between the end face of the disk 16 and the end surface in the wall 11.

Figure 22:
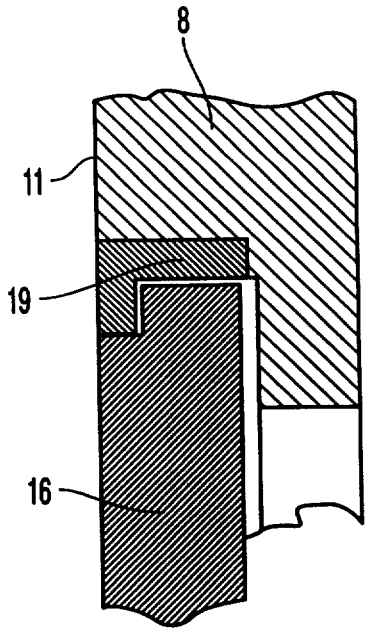

FIG. 22 shows an embodiment of an annular sealing 19 between the disk (or ring) 16 and the wall 11 of the stator 8. The sealing 19 is made as an annular insert representing a shaped ring or a grooved ring (turned-off).

Figure 23:
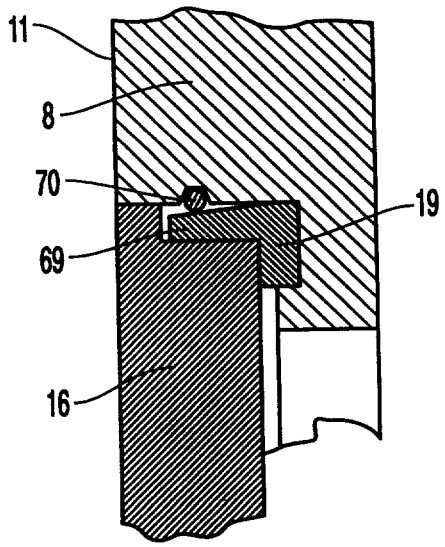

Another embodiment of the annular sealing 19, shown in FIG. 23, represents an annular insert with a conical section 69 and the elastic ring 70.

Figure 24:
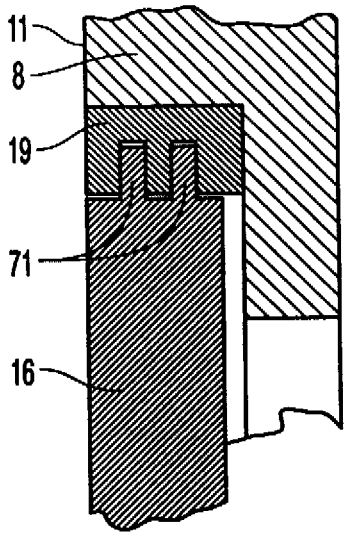

A third embodiment of the annular sealing 19 is shown in FIG. 24. The insert is made to have labyrinth sealing 71 on the external cylindrical surface of the rotary disk 16.

Figure 25:
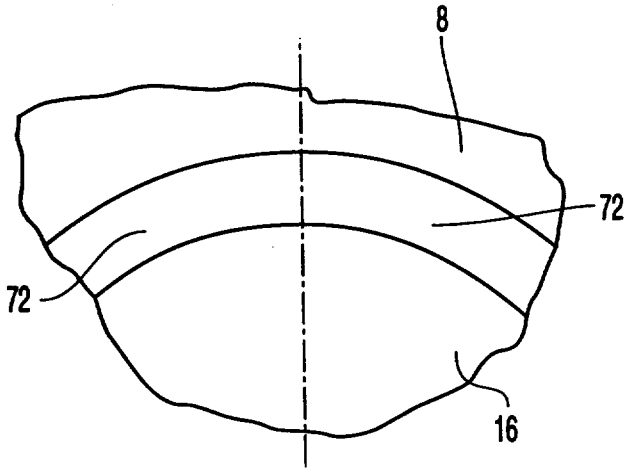

In FIG. 25, it is shown that, in order to ensure the possibility of assembling, the insert is made of separate sectors 72.

EMBODIMENTS OF THE CLAIMED ARRANGEMENT WITH A STATOR HAVING MORE THAN THREE WORKING CHAMBERS

Besides the embodiment with a stator having a triangular cross-section and a two-vertex rotor-piston, as described above, the arrangement may have a stator, the cross-section of the side wall of which that is perpendicular to the axis 21 of the shaft 1 is shaped as a regular N-angled polygon, where N is more than 3 (a square in FIG. 26, a pentagon in FIG. 27, and a hexagon in FIG. 28), with rounded-off corners 25 and straight or smooth convex lines 26 of its sides. The geometrical parameters of this N-angled polygon are related to a value of the eccentricity E between the axis 21 of the shaft 1 and the axis 22 of the eccentric portion 2 of the shaft. For instance, the side 73 (FIG. 26) of the square in the cross-section of the stator of the arrangement with four working chambers is equal to or more than sixteen times the eccentricity E. In this case, the ratio of the diameter of the pinion to the diameter of the gear-wheel is equal to 3:4. Respectively, each cross-section of the side surface 7 of the rotor that is perpendicular to the axis 22 of the eccentric portion of the shaft, represents a convex closed line having N−1 points 28 that are most distant from the axis 22 of the eccentric portion of the shaft, whereas the convex side surface 7 of the rotor-piston which is in contact with N working sections 30 (segments) of the stator divides the internal space of the stator into N working chambers 23 of variable capacity. In this embodiment, the toothed gearing between the rotor and stator can be disposed inside the rotor, like in the prototype. Along with this, all the particularities of the arrangement of the stator B and rotor-piston 3 as described herein above when discussing the arrangement with N equal to 3 and concerning the cooling system, the cartridge 50 with sealing members 35 and the rotary disk 16 are retained also in the arrangements with an N-angled polygon stator where N is more than 3.

In another embodiment of the arrangement with an N-angled stator when N is more than 3, the toothed gearing between the rotor and stator can be placed outside the internal space 9 of the stator. In this case, the working chambers 23 are sealed by means of a rotary disk 16 or a rotary ring. The diameter of the opening 15 in the end wall 11 of the stator must be made sufficient for passing the bushing 4 therethrough and for ensuring its rotation, i.e. it must be larger than E+0.5d, where E=value of the distance between the axis 21 of the shaft 1 and the axis 22 of the eccentric portion 2 of the shaft, and d=external diameter of the bushing 4.

However, the geometrical parameters of an N-angled polygon, when N is more than 3, allow, with some additional limitations imposed on the size of the opening 15 in the wall 11 of the stator, to make such an embodiment of the arrangement, in which the opening 15 in the wall 11 of the stator is not closed by the rotary disk or ring (FIG. 29). Sealing of the working chambers in the internal space of the stator 8 is ensured in this case by the end wall 6 of the rotor-piston or its portion. The opening 15 in the wall 11 of the stator may then have also not a circular shape. The above-mentioned limitations for a four-angled stator could have been formulated as follows: in the end wall 11 of the stator 8 there is an opening 15, the distance from any point of the stator wall 11 in the opening 15 to the axis 21 of the shaft 1 is larger than E+0.5d and smaller than the distance from the axis 22 of the eccentric portion 2 of the shaft to the point of the side surface 7 of the rotor-piston 3 that is nearest to the axis 22 of the eccentric portion of the shaft minus E. The above-mentioned dimensions of the opening 15 ensure sealing of the working chambers.

On the basis of this invention, besides an internal combustion, it is possible to make a pump, a compressor or a hydraulic motor. In case of using this power plant as a pump, there is no necessity to have a system for initiating the process (ignition), and correspondingly varies the system for distributing working medium. The rotor-piston 3 can be made to have the bushing 4 disposed beyond the internal space 9 of the stator, but since the working medium pumped over by the pump can accomplish the function of cooling, the rotor-piston may have no forced cooling system. In some cases, it is not reasonable to provide the pump with a cartridge 50 with sealing members 35, the arrangement of which is described above, for instance, where the working medium being pumped over possesses a sufficient viscosity. In case if this power plant is used as a compressor, there is also no necessity to have a system for initiating the process (ignition), and the system for distributing working medium also varies. But in some cases, it is still necessary to use the above-described cartridges 50 with sealing members 35, as well as the system for forced cooling of rotor-piston with cooling channels 32 and manifolds 37 and 39. The toothed gearing consisting of the pinion 13 and the gear-wheel 14, with the number N of working chambers equal to three, must be made outside the internal space 9 of the stator, whereas for the compressors and pumps, when N is more than 3, the gearing can be either outside or inside this space. The arrangement of a hydraulic motor does not practivally differ from that of a pump.

OPERATION OF THE CLAIMED ARRANGEMENT

In the mode of engine, the power plant operates as follows.

By rotating the shaft 1 (FIG. 3), the rotor-piston 3 is rotated through the toothed gearing (pinion 13 and gear-wheel 14). Kinematic links actuate the distribution mechanism 24 for working medium and the system 36 (FIG. 6) for initiating the working process. The rotor-piston 3, while rotating about two axes—the axis 21 of the shaft 1 and the axis 22 of the eccentric portion 2 of the shaft, owing to the pinion 12 and the gear-wheel 14 being in mesh, describes within the internal space of the stator 8 such a trajectory with which the side surface 7 of the rotor piston is in a continuous contact with the surface of all the segments 17 of the stator 8. In doing so, the side surface 7 of the rotor-piston "revolves" completely, i.e. all its points in some succession come into contact with the surface of the segments 17. The lines of contact between the side surface 7 of the rotor-piston 3 and the segments 17 divide the internal space of the stator 8 into the working chambers 23 of variable capacity. Each working chamber 23 alternately changes its capacity, periodically extending to its maximum size and then contacting to its minimum size when the two-vertex rotor-piston reaches with its vertex one of the corners of the stator. Variation in the capacity of the working chambers 23 goes on in accordance with the phases of the working process (see FIG. 30). By way of an example for a four-stroke working cycle (although a two-stroke working cycle can also be realized), phases are shown for each working chamber by means of circular diagrams, where the shaded sectors denote the phase of the working process in the combustion chamber at the moment when the rotor-piston 3 is in the shown position, and the arrows indicate the order in which the phases follow each other in each combustion chamber. When the rotor-piston 3 rotates clockwise, compression of the working medium (designated by the letter C in the drawing) takes place in the working chamber K1, the channels for the supply and removal of the working medium are closed by valve devices, combustion and expansion of the working medium (designated by the letter P in the drawing) takes place in the working chamber K2, and exhaust of the working medium through an open channel for removal of the working medium (designated by the letter B in the drawing) takes place in the working chamber K3. With further rotation of the rotor-piston 3, the phases in the working chambers will change until the full cycle is completed in every working chamber, depending upon the position of the rotor-piston. Thus, in the chamber K3 after the phase B there begins the phase H—filling the working chamber with the working medium, and so on.

In the embodiment with a two-vertex rotor-piston and a triangular stator in its cross-section, the toothed gearing is effected outside the internal space 9 of the stator (FIG. 1). For this purpose, a bushing 4 is used which allows to dispose the pinion 13 beyond the space 9 of the stator 8. In the opening 15 provided in the wall 11 of the stator, which is coaxial with the shaft 1, a disk 16 is rotating, in which there is in its turn an opening 31 coaxial with the eccentric portion 2 of the shaft. The bushing 4 extends through the opening 31 in the disk 16 of the stator. The eccentric portion 2 of the shaft, while being rotated, turns itself and through the bushing 4 rotates the disk 16 around the shaft 1. The disk 16 seals the internal space 9 of the stator and more exactly, each of its working chambers.

The cartridges 50 with plate-type unloaded sealing members 35 (FIG. 13) prevent the working medium from flowing over from one working chamber to another. Owing to pressure of gases in the working chamber 55, a sealing force emerges that presses the sealing member 35 to the side surface of the fin 54 of the holder 34 (FIG. 15). This force is proportional to the differential pressure in the adjacent working chambers 55 and 56. This process is described in the book: "Designing and Engineering the Internal Combustion Engines", edited by N. Kh. Dyachenko, Leningrand, "Mashinostroyeniye" Publishers, 1979, page 233, FIG. VI-20. The force exerted to the flat sealing member 35 in the direction towards the surface 7 of the rotor-piston 3 is made up of a force developed by the spring member 46 and the difference between approximately equal pressures developed by working medium of the surfaces 57 and 58 of the flat sealing member 35. The clearance 59 in the slot 43 ensures passing of the gas into the internal space of the slot 43. Balancing of gas pressure on the upper and lower surfaces 57 and 58 of the unloaded sealing member 35 takes place, and gas pressure in the clearance 59 forces the side surface 60 of the unloaded sealing member 35 against the side surface of the fin 54. Therefore, it is mainly the force of the resilient spring member 46 that acts on the side surface 7 of the rotor-piston 3. If the fixing means is made as a bar 45, the openings 51 in the sealing members are made of a larger diameter than the external diameter of the bar 45 (FIG. 14). This difference in diameters determines the amplitude of displacing the members 35 towards the internal space 9 of the stator 8. The sealing members 35 can be arranged in the cartridge 50 with a variable pitch 52, thus allowing to distribute pressure of wroking medium more efficiently between them.

Cooling of the rotor-piston and the stator ensures stabilization of their geometrical shape owing to smaller temperature deformations, thus facilitating the work of the sealing members. The physics of the influence of thermal loads is described in the book: "Designing and Engineering Internal Combustion Engines", edited by N. Kh. Dyachenko, Leningrand, "Mashinostroyeniye" Publishers, 1979, page 238, FIG. VI-24.

Figure 8:
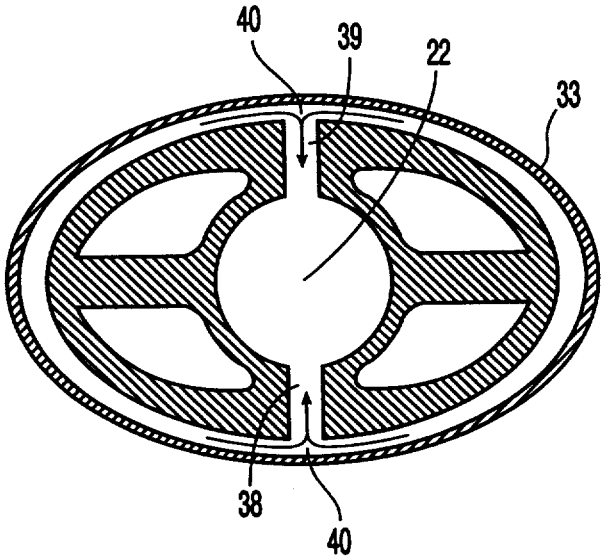
FIG. 8 is a cross-section of the two-vertex rotor-piston as passed through the drain manifolds of the cooling system.

In the embodiment with a triangular stator, two thermal modes of rotor operation are possible, depending upon the arrangement of initiating the working process. In the first case, the most stringent thermal loads emerge at the sections 38 of the side surface 7 of the rotor-piston 3 that are most distant from the eccentric portion of the shaft, and the design of the cooling system of the rotor-piston shown in FIG. 7 and FIG. 8 is used in this case. Coolant from the pressure manifolds 37 (FIG. 7) flows to the sections 38 of the cooling channels that are most distant from the axis of the eccentric portion of the shaft, and then (FIG. 8) through the sections 40 of the cooling channels that are nearest to this axis the coolant goes into the drain manifolds 39.

In the second case (FIG. 9 and FIG. 10) the most stringent thermal loads emerge at one, for instance, the upper (FIG. 9) lateral side of the side surface 7 of the rotor-piston, which is heated more than the lateral side of the side surface of the rotor that is opposit to it, and the design of the cooling system of the rotor-piston shown in FIG. 9 and FIG. 10 is used in this case. Coolant from the pressure manifold 37 flows to the upper (FIG. 9) section 40 of the cooling channels that is nearest to the axis of the eccentric portion of the shaft, and then through the lower (FIG. 10) section 40 of the cooling channels that is nearest to this axis the coolant goes into the drain manifold 39. When coolant flows over the channels, heat from the upper side is carried over to the lower side of the side surface 7 of the rotor-piston 3, thus reducing the thermal deformations of the latter.

Figure 11:
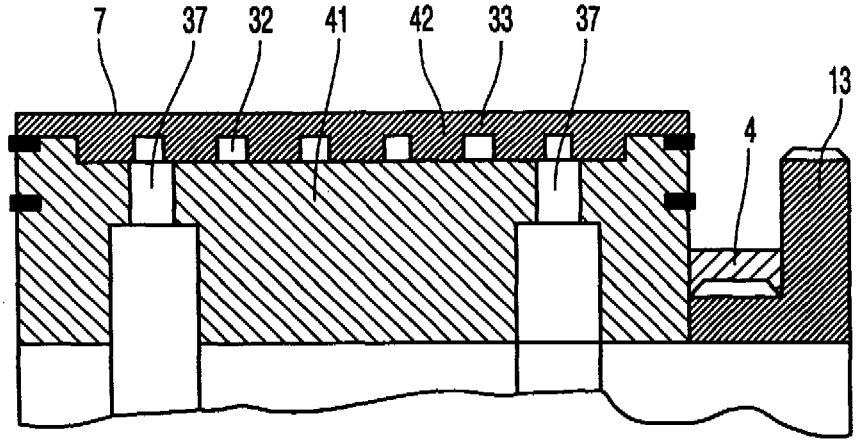
FIG. 11 is a fragment of a longitudinal section of the rotor-piston with a finned shell.

Fins 42 made on the internal portion of the shell 33 (FIG. 11) allow to improve cooling of the rotor-piston 3.

Operation of the arrangements with a polygonal stator, for instance, with N=4, in principle, does not differ from operation of a machine with a triangular stator as described herein above. Although the arrangement with a triangular stator is in many cases more preferable, the claimed embodiments with a polygonal stator (N more than three) allow to extend the circle of application for this invention, for instance, owing to combining several function in a single arrangement. Operation of a power plant with a polygonal stator (N more than three) goes on as follows. Like also in the case described herein above, the working chambers 23 alternately change their capacity, periodically extending to their maximum size and than contracting to their minimum size. Thus, variation in the capacities of the working chambers 23 takes place in accordance with the phase of the working process. By way of an example for a four-stroke working cycle (FIG. 31), phases are shown for each working chamber by means of circular diagrams, where the shaded sectors denote the phases at the moment when the rotor-piston 3 is in shown position inside the internal space 9 of the stator, and the arrows indicate the order in which the phases follow each other in each combustion chamber. When the rotor-piston 3 moves clockwise, compression of the working medium (phase C) takes place in the working chamber K1, the channels for the supply and removal of the working medium are closed by valve devices, combustion and expansion of the working medium (phase P) takes place in the working chamber K2, exhaust through an open channel for removal of the working medium (phase B) takes place in the working chamber K3, and filling of the working chamber through an open channel for the supply of the working medium (phase H) takes place in the working chamber K4. With further rotation of the rotor-piston, the phases in the working chambers 23 will change until the full cycle is completed in every working chamber, depending upon the position of the rotor-piston.

The compression ratio for the working medium, among all other factors, depends also upon the number of working chambers: the larger their number is, the lower is the compression ratio because of a reduction in the difference between the cross-sectional areas of the rotor-piston and the stator (FIG. 4, FIG. 26, FIG. 27, and FIG. 28).

A machine with an N-angled polygonal stator (N more than three), in distinction to the machine with a triangular stator, allows to dispose the toothed gearing (pinion 13 and gear-wheel 14) inside the space 9 of the stator, however the nature of interaction of the surface 7 of the rotor-piston with the segments 17 and with the cartridges 50 having a set of unloaded sealing members 35 and disposed therein does not change in this case. Work of the unloaded sealing members 35 to the cartridge 50 is absolutely similar to what is described above.

In operation of a power plant with an N-angled polygonal stator (N more than three), the sections of the side surface 7 of the rotor-piston 3 that are most distant from the axis 22 are subjected to the highest thermal load with any arrangement used for initiating the working process. Therefore, the pressure manifolds of the cooling system are connected to these sections, and the drain manifolds are connected to the sections of the side surface 7 of the rotor-piston 3 that are least distant from the axis 22 (similarly to what is shown in FIG. 7 and FIG. 8 for the triangular stator).

In operation of a power plant with an N-angled polygonal stator (N more than three) and with an external position of the toothed gearing, there is the following perculiarity. An embodiment (shown in FIG. 29) is possible when the opening 15 in the stator wall is not closed with a disk or ring, and in this case the rotor-piston 3 during its rotation closes with its end face 6 that portion of the opening 15 which could have unsealed the internal cavity of the working chambers 23.

The claimed invention can be implemented in an industrial manner.

In accordance with this patent specification, various power plants can be made, including internal combustion engine, compressors and pumps, as well as power plants which are a combination of engine, compressor or pump, combined in various ways. Thus, owing to the claimed arrangement of the sealing which separates reliably the working chambers, within a single stator of such a power plant, there can be provided a compressor, the power for operation of which will be given by an engine disposed in the same stator, i.e. one part of the working chambers operates in the mode of compressor, and the other part thereof, in the mode of engine. In a single stator, there can be arranged also several compressors (pumps, hydraulic motors), wherein each element of the power plant will work with its own working medium and have its own inlet and outlet. The invention can be implemented in multisectional arrangements (with several stators operating on a single shaft), wherein the working chambers both in one section and in different sections can be connected in various ways in order to attain the desired effect.

The placement of the toothed gearing outside the internal space of the rotor allows, owing to more space being thus available, to increase the size and carrying capacity of the bearing of the rotor-piston.

The invention can be realized such that the power plant will have two toothed gearings between the rotor and the stator, which are disposed outside the internals space of the stator on both sides of the rotor, thus ensuring a symmetrical design and more uniform distribution of load.

Depending on the requirements imposed on a particular power plant, it can be made with the sealing, rotor cooling and toothed gearing proposed in this patent specification, in various combinations. For instance, in a multichamber pump with the same working medium for all chambers, there is no need to be afraid that the working medium will penetrate the adjacent working chambers or that the rotor gets overheated, since the working medium itself can play the role of coolant. In this case, it is necessary to used the proposed technical solution concerning the toothed gearing, and this will allow to ensure a high specific capacity of the pump per volume unit. an, when making an engine, it is necessary to use the sealing members, the toothed gearing and the system for cooling the rotor, as proposed in this patent specification.

The example of implementing this invention that are given in the patent specification are only an illustration thereof and do not limit the Applicants' claims for other embodiments within the scope of the set of patent claims proposed for this invention.

We claim:

1. A power plant comprising a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having three working sections in constant contact with the rotor-piston, segments which are arranged on the working sections of the side wall of the stator, a toothed gearing in the form of a pinion connected to the rotor-piston and of an internal gear-wheel rigidly connected to the stator, wherein each cross-section of the rotor-piston side surface that is perpendicular to the axis of the eccentric portion of the shaft, represents a convex closed line having two points that are most distant from the axis of the eccentric portion of the shaft and disposed symmentrically thereto, each cross-section of the stator side wall that is perpendicular to the axis of the shaft is shaped as a regular triangle with straight or smooth convex lines of its sides, and the internal space of the stator is divided into three working chambers of variable capacity by the lines of contact between the convex side surface of said rotor-piston and the three working sections of the stator, CHARACTERIZED in that said power plant has a bushing of external diameter d rigidly connected to the rotor-piston, in the end wall of the stator there is a circular opening which is coaxial with the shaft and has a diameter larger than E+0.5d, where E=distance between the axis of said shaft and the axis of said eccentric portion thereof, a rotary disk is mounted in said opening coaxially with the shaft, the bushing reaches beyond the internal space of the stator and extends through an opening in the rotary disk, the pinion of said toothed gearing is connected rigidly to the bushing and is coaxial therewith, said toothed gearing is placed in the stator beyond the internal space thereof, and an annular seal is mounted between the stator and the rotary disk.

2. The power plant according to claim 1, CHARACTERIZED in that said internal cavity of the rotor-piston comprises a set of closed channels arranged under the side surface of the rotor-piston, and a pressure and a drain manifold for forced cooling, wherein the sections of the closed channels that are most distant from the axis of the eccentric portion of the shaft are connected to the pressure manifold, and the sections of the closed channels that are nearest to the axis of the eccentric portion of the shaft are connected to the drain manifold.

3. The power plant according to claim 1, CHARACTERIZED in that said internal cavity of the rotor-piston comprises a set of closed channels arranged under the side surface of the rotor-piston, and a pressure and drain manifolds for forced cooling, wherein the sections of the closed channels that are least distant from the axis of the eccentric portion of the shaft on one side of the rotor-piston side surface relative to said axis are connected to the drain manifold, and the sections of the closed channels that are least distant from the axis of the eccentric portion of the shaft on the other side of the rotor-piston side surface relative to said axis are connected to the pressure manifold.

4. The power plant according to claim 2, CHARACTERIZED in that said rotor-piston comprises a body and a finned shell, said shell fins being supported by the body so as to define closed channels.

5. The power plant according to claim 1, CHARACTERIZED in that each segment comprises a set of unloaded sealing members and spring members, said sealing members being capable of limited movement towards the internal space of the stator and back, while being in contact with the end walls of the stator, various combinations of said sealing members are in contact with the side surface of the rotor-piston at different orbital positions of the rotor-piston, and points throughout the entire length of at least one sealing member in each segment are in contact with the side surface of the rotor-piston.

6. The power plant according to claim 5, CHARACTERIZED in that said segment is made as a cartridge having a holder with fins and slots facing the internal space of the stator and disposed with a predetermined pitch on said working sections so as to extend in the direction from one end wall of the stator to the other end wall thereof, means for fixing said sealing members, a flange connected to the holder and disposed outside the internal space of the stator and provided with best-removal elements, a mounting surface with a sealing between the stator and the cartridge, said sealing members and said spring members which are in contact with them being disposed in the slots between the holder fins.

7. The power plant according to claim 6, CHARACTERIZED in that said sealing members and said holder fins have openings extending therethrough, and said means for fixing said sealing members is made as a bar inserted in said openings extending therethrough.

8. The power plant according to claim 1, CHARACTERIZED in that said bushing and said pinion are connected with one another by means of a splined joint, the pinion splines being made as extensions of its teeth.

9. A power plant comprising a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon with N rounded-off corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity, CHARACTERIZED in that each segment contains a set of unloaded sealing members and spring members, said sealing members being capable of limited movement towards the internal space of the stator and back while being in contact with the end walls of the stator, various combinations of said sealing members are in contact with the side surface of the rotor as different orbital positions of the rotor-piston, and points throughout the entire length of at least one sealing member in each segment are in contact with the side surface of the rotor-piston.

10. The power plant according to claim 9, CHARACTERIZED in that said internal cavity of the rotor-piston is provided with a cooling system which comprises a set of closed channels arranged under the side surface of the rotor-piston, and a pressure and a drain manifolds for forced cooling, wherein the sections of the closed channels that are most distant from the axis of the eccentric portion of the shaft are connected to the pressure manifold, and the sections of the closed channels that are nearest to the axis of the eccentric portion of the shaft are connected to the drain manifold.

11. The power plant according to claim 10, CHARACTERIZED in that said rotor-piston comprises a body and a finned shell, said shell fins being supported by the body so as to define said channels.

12. The power plant according to claim 9, CHARACTERIZED in that said segment is made as a cartridge having a holder with fins and slots facing the internal space of the stator and disposed with a predetermined pitch on said working sections so as to extend in the direction from one end wall of the stator to the other end wall thereof, means for fixing said sealing members, a flange connected to the holder and disposed outside the internal space of the stator and provided with heat-removal elements, a mounting surface with a sealing between the stator and the cartridge, said sealing members and said spring members which are in contact with them being disposed in the slots between the fins.

13. The power plant according to claim 12, CHARACTERIZED in that said sealing members and said holder fins have openings extending therethrough, and said means for fixing said sealing members is made as a bar inserted in said openings extending therethrough.

14. A power plant comprising a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon with N rounded-off corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity, CHARACTERIZED in that said power plant has a bushing of external diameter d rigidly connected to the rotor-piston, in the end wall of the stator there is an opening, the distance from any point of the stator wall in said opening to the axis of the shaft is larger than E+0.5d and smaller than the distance from the axis of the eccentric portion of the shaft to the point of the rotor-piston side surface that is nearest to the axis of the eccentric portion of the shaft minus E, where E=distance between the axis of said shaft and the axis of said eccentric portion of the shaft, the bushing reaches beyond the internal space of the stator and extends through said opening in the end wall of the stator, the pinion of said toothed gearing is connected rigidly to the bushing and is coaxial therewith, said toothed gearing being disposed in the stator wall or beyond it outside the internal space of the stator.

15. A power plant comprising a shaft with an eccentric portion, a rotor-piston mounted on the eccentric portion of the shaft and having an internal cavity and an external surface made up of end surfaces and a convex side surface, a stator with an internal space to receive the rotor-piston therein, said space being defined by two flat parallel end walls and a closed side wall having segments in constant contact with the rotor-piston, a toothed gearing in the form of a pinion connected to the rotor-piston and of an internal gear-wheel rigidly connected to the stator, wherein each cross-section of the stator side wall that is perpendicular to the axis of the shaft is shaped as a regular polygon having N rounded-off corners and straight or smooth convex lines of its sides, where N is at least four, N working sections are arranged one on each of N faces of the stator side surface, each cross-section of the rotor side surface that is perpendicular to the axis of the eccentric portion of the shaft, represents a convex closed line having N−1 points that are most distant from the axis of the eccentric portion of the shaft, and the convex side surface of the rotor-piston which is in contact with N working sections of the stator divides the internal space of the stator into N working chambers of variable capacity, CHARACTERIZED in that said power plant has a bushing of external diameter d rigidly connected to the rotor-piston, in the end wall of the stator there is a circular opening which is coaxial with the shaft and has a diameter larger than E+0.5d, where E=distance between the axis of said shaft and the axis of said eccentric portion thereof, in said opening a rotary disk or ring provided with an annular sealing is mounted coaxially with the shaft, which disk or ring has the external circumference diameter thereof smaller than the diameter of said opening twice the sealing thickness, the bushing reaches beyond the internal space of the stator and extends through an opening in the rotary disk or a recess in the rotary ring, the pinion of said toothed gearing is connected rigidly to the bushing and is coaxial therewith, said toothed gearing is placed in the stator beyond the internal space thereof.

* * * * *